United States Patent [19]

Hasselbring

[11] 4,220,278

[45] Sep. 2, 1980

[54] DOUBLE DOOR MAILBOX

[76] Inventor: Rae E. Hasselbring, 5336 Forest Acres Dr., Nashville, Tenn. 37220

[21] Appl. No.: 960,093

[22] Filed: Nov. 13, 1978

[51] Int. Cl.[2] ..... B65D 91/00

[52] U.S. Cl. ..... 232/35; 232/17; 232/45

[58] Field of Search ..... 232/17–25, 232/34, 35, 44, 45

[56] References Cited

U.S. PATENT DOCUMENTS

| | | | |
|---|---|---|---|
| 1,305,722 | 6/1919 | Kees | 232/23 |
| 1,538,591 | 5/1925 | Rastetter | 232/19 |
| 2,849,175 | 8/1958 | Thieman | 232/45 X |
| 3,106,335 | 10/1963 | Allan | 232/17 |
| 4,005,816 | 2/1977 | Malik | 232/17 X |

FOREIGN PATENT DOCUMENTS

| | | | |
|---|---|---|---|
| 36326 | 10/1966 | Finland | 232/19 |

*Primary Examiner*—Roy D. Frazier
*Assistant Examiner*—Peter A. Aschenbrenner
*Attorney, Agent, or Firm*—Harrington A. Lackey

[57] ABSTRACT

A double door mailbox having elongated link rods with lost motion structure, for connecting the front and rear doors of the mailbox so that both doors may be closed at the same time, but only one door at a time can be opened.

The mailbox structure is further characterized by a signal member adapted to be moved by the link rods between a protracted position visible through the rear door and a retracted position.

6 Claims, 5 Drawing Figures

DOUBLE DOOR MAILBOX

BACKGROUND OF THE INVENTION

This invention relates to a double door mailbox, and more particularly to a mailbox having interconnected front and rear doors.

Double door mailboxes are known in the art, as shown in the following U.S. patents:

| | | |
|---|---|---|
| 621,973 | Peers | March 28,1899 |
| 3,680,773 | Thompson | August 1, 1972 |
| 3,942,715 | Anderson | March 9,1976 |
| 4,005,816 | Malik | February 1, 1977 |

Mailboxes having door-actuated signal devices are numerous. Some of these door-actuated signal devices are disclosed in the following U.S. patents:

| | | |
|---|---|---|
| 1,990,003 | Schlenker | February 5, 1935 |
| 3,606,141 | Taylor | September 20, 1971 |
| 3,891,139 | Redling | June 24, 1975 |

Double door mailboxes having door-actuated signal devices are also disclosed in the above Peers U.S. Pat. No. 621,973 and the Malik U.S. Pat. No. 4,005,816.

The Malik patent also disclosed links between each of the front and rear doors of a mailbox and a signal device, permitting the front door to be automatically closed when the rear door is open.

SUMMARY OF THE INVENTION

The mailbox made in accordance with this invention includes a front door and a rear door which are interlinked to permit the front door to be opened while the rear door is closed, the rear door to be opened while the front door is closed, and both doors to be closed at the same time. However, both doors cannot be opened at the same time.

The invention further contemplates a signal device connected to the door linkage for movement between a protracted signal position and a retracted position to apprise the owner of the mailbox when the mail has been delivered.

More specifically, the mailbox includes a front door adapted to open and close a front access opening for receiving mail in the mailbox housing and a rear door for opening and closing a rear access opening through which mail can be retrieved by the owner.

The front and rear doors are connected to an elongated rod member including a front link rod connected to the front door and a rear link rod connected to the rear door, the link rods being interconnected to each other by a lost motion structure to permit either door to be opened or closed while the opposite door is closed, but to prevent opening of both doors at the same time.

The specific lost motion construction includes a rear loop member formed on the rear end of the front link rod surrounding the rear link rod and a front loop member formed on the front end of the rear link rod surrounding the front link rod, each loop member permitting free slidable movement of the surrounded link rod. When both link rods are extended longitudinally their maximum extensible length is limited by engagement of the loop members against each other.

The signal member includes a visible signal panel on the rear end of the member adapted to be moved into a protracted position registering with a signal opening in the closed rear door, and to be moved away from the opening to a retracted position. The signal member further includes a yoke member slidably engaging the intermediate portions of both link rods between the loop members, so that movement of either link member toward the yoke member will engage the yoke member and thereby move the signal member a corresponding distance. Thus, when the signal member is in a retracted position, and the front door is closed, the signal member is moved to a protracted position by opening the rear door. Closure of the rear door has no effect upon the movement of the signal member. Opening of the front door causes the signal member to move forwardly to its retracted position, while closing of the front door has no effect upon the movement of the signal member.

Thus, when the signal member is in its protracted position, it indicates to the mailbox owner that the mailman has not come. When the mailman comes, opens the front door and moves the signal member to its retracted position and then closes the front door, the absence of the visible signal panel in the registering signal opening in the rear door apprises the owner that the mail has arrived. The owner resets the signal member by opening the rear door when he retrieves the mail.

Should one door at either end of the mailbox be left open, opening of the opposite door will automatically close the one door. Thus, if the homeowner leaves open the rear door, the opening of the front door by the postman will automatically close the rear door, so that the signal opening in the rear door will always be in position to indicate the presence of mail. Moreover, should the postman leave the front door open, the opening of the rear door by the owner will automatically close the front door and simultaneously reset the signal member.

DESCRIPTION OF THE PREFERRED EMBODIMENTS

Figures 1, 2, 3, 4, 5:
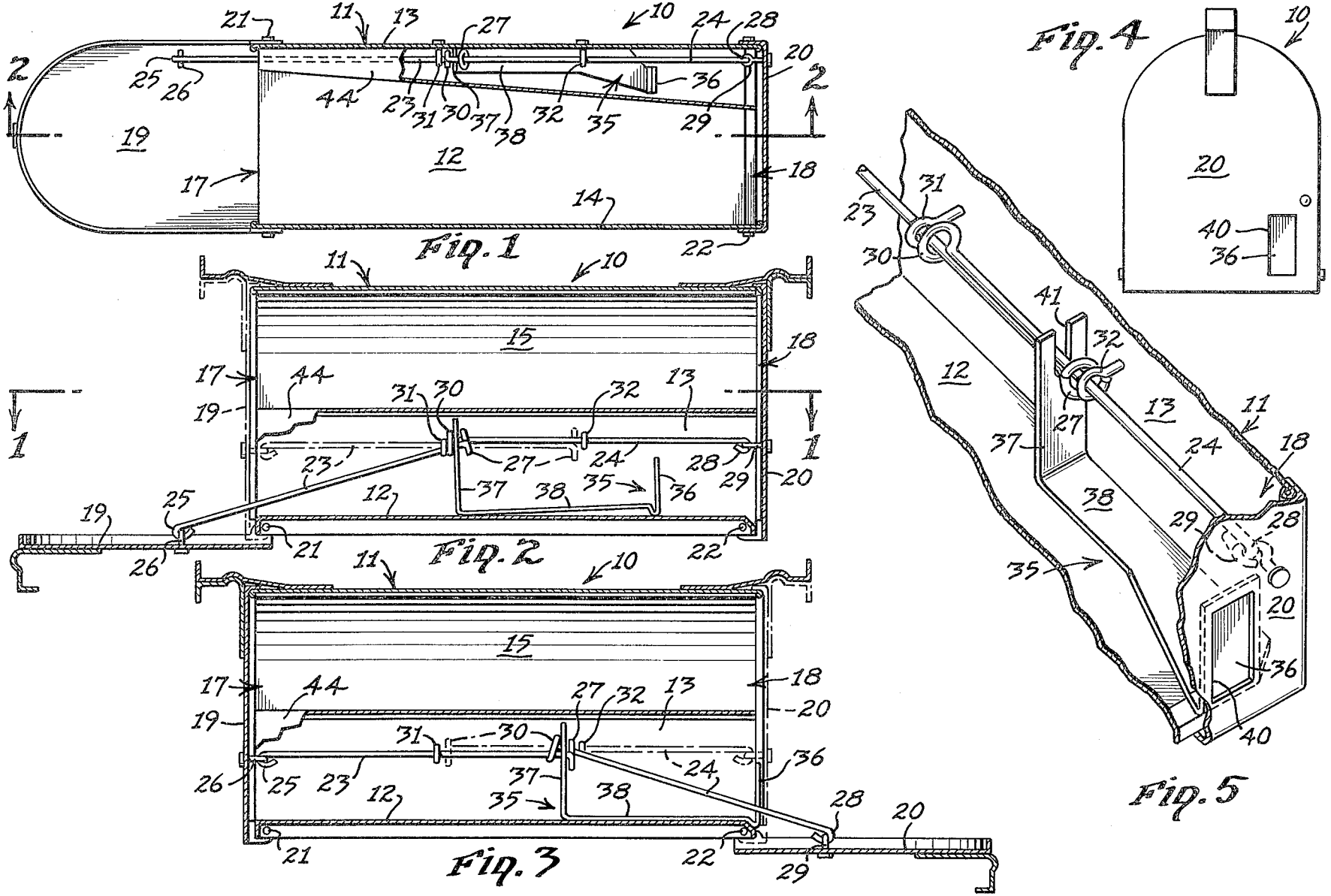
FIG. 1 is a top plan section, taken along the line 1—1 of FIG. 2 of a mailbox made in accordance with this invention, with the rear door closed, the front door open, and the signal member in its retracted position, and with portions of the linkage housing broken away.
FIG. 2 is a section taken along the line 2—2 of FIG. 1; with portions of the linkage housing broken away.
FIG. 3 is a sectional elevation similar to FIG. 2; with the front door closed, the rear door open, and the signal member in its protracted position.
FIG. 4 is a rear elevation of the mailbox, with the rear door closed, and the signal member visible through the registering signal opening.
FIG. 5 is an enlarged, fragmentary, perspective view of the lower rear portion of the mailbox, disclosing the rear door closed and the signal member in its protracted position.

Referring now to the drawings in more detail, the mailbox 10, made in accordance with this invention, includes a rather conventional mailbox housing 11 having a bottom wall 12 and a pair of side walls 13 and 14 terminating in an arched top wall 15. The housing 11 includes a front access opening 17 and a rear access opening 18.

Adapted to close the front access opening 17 in a conventional manner is front door 19. A similarly constructed rear door 20 is adapted to open and close the rear access opening 18. The doors 19 and 20 are hinged along their bottom edges to the corresponding portions of the bottom wall 12 by hinge pins 21 and 22.

The front and rear doors 19 and 20 are interconnected by an elongated rod means including a front link rod 23 and a rear link rod 24. The front end of the front link rod 23 forms a front hook 25 coupled to a front eye 26 fixed to the front door 19.

The rear end portion of the front link rod 23 forms a rear loop member or guide member 27 surrounding the front portion of the rear link rod 24 for free longitudinal axial movement of the rear link rod 24 within the loop member 27.

In a similar manner, the rear end portion of the rear link rod 24 forms a rear hook 28 coupled to the rear eye 29 fixed to the rear door 20. The front end portion of the rear link 24 forms a front loop member or guide member 30 freely surrounding and receiving for axial movement the rear portion of the front link rod 23.

The link rods 23 and 24 are mounted for longitudinal reciprocal movement in the guide members or eyes 31 and 32, fixed to the inner surface of the side wall 13.

The loop members 27 and 30 are spaced farthest apart from each other when both doors 19 and 20 are closed, as illustrated in FIG. 2 by the phantom positions of the front door 19 and the front link rod 23 and the solid-line positions of the rear door 20 and rear link rod 24.

The loop members 27 and 30 are moved toward engagement with each other to limit the extension of the link rods 23 and 24 from each other. In FIG. 2, the loop members 27 and 30 are proximate to each other when the front door 19 is open and the rear door 20 is closed. FIG. 3 discloses the loop members 27 and 30 proximate to each other, when the front door 19 is closed and the rear door 20 is open.

Thus, although it is possible for both front and rear doors 19 and 20 to be closed at the same time, and for the front door 19 to be opened while the rear door 20 is closed or the front door 19 is closed while the rear door 20 is opened, nevertheless, it is not possible for both doors 19 and 20 to be opened at the same time, because of the limitation of the maximum combined length of the extended link rods 23 and 24.

Another feature of this invention is a signal member 35 having a clearly visible rear signal panel 36 and an upstanding connector member or yoke member 37 longitudinally spaced apart on a base member 38. The highly visible signal panel 36 is adapted to register with a signal opening 40 in the rear door 20, when the signal member 35 is moved to its rearmost protracted position, as disclosed in FIGS. 3, 4 and 5. When the signal member 35 is moved to its retracted concealed position, as disclosed in FIGS. 1 and 2, the signal panel 36 will not be visible through the signal opening 40.

The connector member or yoke member 37 is spaced forward from the visible signal panel 36 a sufficient distance that the yoke member 37, having a vertically opening slot 41 therein, will receive the overlapping portions of the link rods 23 and 24 between the loop members 27 and 30, as disclosed in FIGS. 1–3 and 5.

The signal member 35 is pulled to its protracted position, as disclosed in FIGS. 3 and 5, by opening the rear door 20 causing the front loop member 30 to engage the yoke 37 and move it rearward as disclosed in FIG. 3. After the rear door 20 is closed, the signal member 35 remains in its protracted position, as disclosed in FIG. 5.

However, with the rear door 20 closed, the opening of the front door 19 will cause the rear loop member 27 to engage the opposite surface of the yoke member 37 and pull the signal member 35 forward to the retracted concealed position disclosed in FIG. 2. The subsequent closing of the front door 19 will cause no movement of the signal member 35.

A linkage housing 44 encloses the space around the link rods 23 and 24, guide members 31 and 32 and the signal member 35, and may be fixed to the side wall 13, in order to provide a large clear space between the housing 44 and the side wall 14 for receiving the mail.

In the operation of the mailbox 10, normally, both doors 19 and 20 are closed, with the signal member 35 disposed in its rearmost protracted position, as disclosed in FIG. 5. Thus, the visible signal panel 36 indicates to the homeowner that there is no mail in the mailbox.

When the postman arrives, he pulls open the front door 19, causing the rear loop member 27 to engage the yoke member 37 and pull forward the signal member 35 until the front door 19 is completely open, as disclosed in solid lines in FIG. 2, and the signal member 35 has been moved to its retracted concealed position. Whether the postman leaves the front door 19 open or closes the front door 19, the signal member 35 will remain in its retracted position, thus indicating to the homeowner that the postman has arrived and the mail has been delivered.

When the homeowner approaches and opens the rear door 20 of mailbox 10, the signal member 35 is pulled rearward to its protracted position, as disclosed in FIG. 3. If the front door 19 was left open by the postman, then the rear loop member 27, being engaged by the yoke member 37, will be pulled rearward with the signal member 35, causing the front door 19 to be automatically closed when the rear door 20 is completely opened, as disclosed in FIG. 3.

After the mail is retrieved through the rear access opening 18, the rear door 20 is closed. However, the signal member 35 will remain in its rearward protracted position.

Should the homeowner leave the rear door 20 open, it will be automatically closed the next time the front door 19 is opened. However, the signal member 35 will remain in its rearward position until the front door 19 is opened, thus insuring that the proper signal will be given to the homeowner regardless of which doors are opened or closed.

Although not disclosed in the drawings, nevertheless the conventional red signal flag may be pivotally supported upon the outside of the side wall 14, for conventional use.

As disclosed in the drawings, the hooks 25 and 28 of the respective link members 23 and 24 are coupled about one third of the distance between the pivot pins 21 and 22 and the upper ends of the respective doors. This positioning permits the link rods 23 and 24 to have the necessary travel length in which to operate, yet permit the respective link rods 23 and 24 to swing down pivotally relative to the other link rod. This pivotal motion is also determined by the size of the openings in the corresponding loop members 27 and 30, as well as the openings through the guide eye members 31 and 32.

What is claimed is:

1. A mailbox comprising:

(a) an elongated mailbox housing having a front access opening and a rear access opening, (b) a front door movable toward and away from said front access opening between a closed position and open position, (c) a rear door movable toward and away from said rear access opening between a closed position and an open position, (d) elongated rod means linking said front door and said rear door, (e) the maximum length of said rod means being substantially equal to the length of said mailbox housing plus the length of the portion of said rod means extending between one of said access openings and a corresponding door in an open position when said other door is in a closed position, (f) said elongated rod means comprising a front link rod and a rear link rod, each having front and rear end portions, first means coupling the front end portion of said front link rod to said front door, and second means coupling the rear end portion of said rear link rod to said rear door, (g) lost motion means operatively coupling said front link rod and said rear link rod to permit relative longitudinal movement between said front link rod and said rear link rod so that both said doors may be in their closed positions at the same time, said lost motion means limiting the longitudinal extension of said front and rear link rods to said maximum length of said rod means.

2. The invention according to claim 1 in which said lost motion means comprises a rear loop member on the rear end portion of said front link rod surrounding said rear link rod, and a front loop member on the front end portion of said rear link rod surrounding said front link rod, the spacing between said front and rear loop members permitting the extended overall length of said front and rear link rods to equal substantially said maximum length when said front and rear loop members are nearest to each other.

3. The invention according to claim 2 further comprising a signal member having a visual signal panel and a connector member, said connector member slidably receiving portions of said front and rear link rods between said front and rear loop members, whereby longitudinal movement of either of said loop members moves said signal member when said moving loop member engages said connector member, said visual signal panel being movable between a rear protracted position visible through said rear door and a forward retracted position.

4. The invention according to claim 3 further comprising a signal opening is said rear door for registry with said visual signal panel in protracted position.

5. The invention according to claim 4 further comprising guide means fixed on the inner surface of a side wall of said mailbox housing for receiving said link rods for free longitudinal movement thereof.

6. The invention according to claim 5 further comprising a linkage housing mounted on said side wall for separating said rod means and said signal means from the mail-receiving space within said mailbox housing.

* * * * *